United States Patent [19]

Roberts

[11] 4,074,954

[45] Feb. 21, 1978

[54] COMPRESSOR

[75] Inventor: William Walter Roberts, Yardley, Pa.

[73] Assignee: Mobil Oil Corporation, New York, N.Y.

[21] Appl. No.: 662,183

[22] Filed: Feb. 27, 1976

[51] Int. Cl.[2] ..... F04C 19/00

[52] U.S. Cl. ..... 418/68

[58] Field of Search ..... 417/67, 68, 69, 78, 417/93, 65, 66, 70, 71, 72, 240, 241; 415/116, 120, 186

[56] References Cited

U.S. PATENT DOCUMENTS

| | | | |
|---|---|---|---|
| 1,156,550 | 10/1915 | Peter | 417/66 |
| 1,781,375 | 11/1930 | Easton | 417/68 |
| 1,792,741 | 2/1931 | Hayton | 417/68 |
| 1,849,929 | 3/1932 | Hayton | 417/68 |
| 3,002,463 | 10/1961 | Lahti | 417/68 |
| 3,719,434 | 3/1973 | Eskeli | 417/78 |

FOREIGN PATENT DOCUMENTS

| | | | |
|---|---|---|---|
| 614,791 | 12/1926 | France | 417/68 |

*Primary Examiner*—Carlton R. Croyle
*Assistant Examiner*—Leonard Smith
*Attorney, Agent, or Firm*—Charles A. Huggett; Malcolm Keen

[57] ABSTRACT

A compressor which may also function as a vacuum pump or as a contactor has a rotor surrounded by a gill ring through which the gas or lower density fluid enters. The gas or lower density fluid, compressed if desired, is discharged from inside the gill ring.

16 Claims, 8 Drawing Figures

COMPRESSOR

BACKGROUND OF THE INVENTION

Compressors and vacuum pumps which use a liquid to effect compression of the gas are known. One widely used type of compressor is the liquid piston liquid ring type which has a rotor or impeller which turns freely inside a cylindrical casing on a center eccentric to that of the casing. The rotor is smaller than the casing and has a number of curved vanes which form open-ended buckets. As the rotor revolves, it carries round with it a working fluid, usually water, which forms a ring around the casing. Because of the eccentric positioning of the rotor axis, the liquid enters and leaves the buckets as the rotor revolves and this movement of the liquid is used to compress the gas. Suitable inlet and discharge ports are provided at the center of the rotor.

A variant of the liquid piston pump has an oval casing which permits two compression cycles for each revolution of the rotor.

Eductors are often used for vacuum systems in preference to compressors with moving parts because they are simple, cheap, easy to operate and require little maintenance. They may also be used to compress a gas or vapor, for pumping a liquid or for contacting two fluids.

The principal disadvantages of the liquid piston compressor are that it has a low efficiency and limited compression ratio. Eductors also have a very low efficiency and a limited compression ratio.

A rotary ejector compressor was proposed by Eskeli in U.S. Pat. No. 3,719,434. This device employs a rotor to accelerate a working fluid to entrain the gas which is then compressed in a vaned casing around the rotor. The compressor may also be used as a vacuum pump, in common with many other compressors.

SUMMARY OF THE INVENTION

I have now devised a compressor which operates on the principle of an eductor or ejector but with a recirculating working fluid coupled with a centrifugal separator. This compressor can provide a high pressure differential in a single stage. It is also capable of providing intimate contact between fluids but with minimum entrainment.

According to the invention the compressor comprises a casing with a rotor inside it, a gill ring surrounding the rotor, a fluid inlet communicating with the space outside the gill ring and a fluid outlet communicating with the space inside the gill ring.

The gill ring, which closely surrounds the rotor comprises a number of stationary vanes which preferably direct the gas which is being compressed into the vanes of the rotor. The vanes of the gill ring are preferably of streamline configuration (in the direction of fluid flow) to avoid turbulence. The compressor operates with a working fluid such as water, an oil or a solution and the design may allow some of the working fluid to be recirculated so as to provide cooling.

Further features of the invention will become apparent from the following description of exemplary embodiments.

DESCRIPTION OF SPECIFIC EMBODIMENTS

Figure 2:
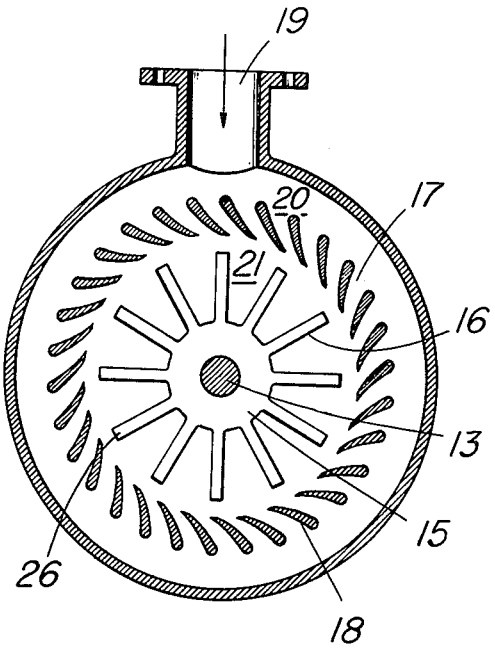
FIG. 2 is a section of the compressor along line 2–2′ of FIG. 1.
Figure 1:
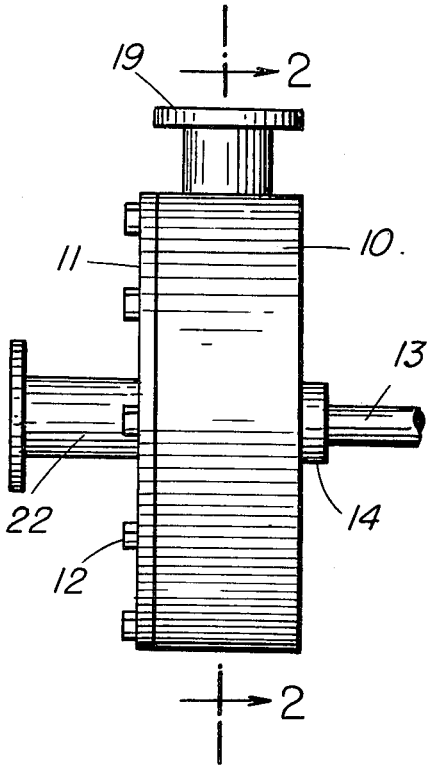
FIG. 1 is a side elevation of the compressor.

The compressor comprises a casing 10 with an end cover plate 11 attached by screws 12. A drive shaft 13 passes into casing 10 through shaft seal and bearing 14. Journalled on shaft 13 is a rotor 15 fitted with vanes 16. The rotor is closely surrounded by a gill ring 17 comprised of a large number of stationary vanes 18 (in FIG. 2 the number of stationary vanes is reduced for clarity). The vanes preferably have a streamline section in order to reduce turbulence. A inlet 19 for the gas to be compressed is fitted on casing 10 and communicates with the space 20 outside gill ring 17. The space 21 inside the gill ring communicates with a discharge 22 for the compressed gas.

The compressor operates as follows: taking air as the gas which is being compressed and water as the motive or working fluid: vanes 16 of rotor 15 sweep the water past the inside of gill ring 17 and thereby create a vacuum in the gill ring which will first draw in the remaining liquid and then air. The air becomes entrained by education in the water and, once inside the gill ring is subjected to a centrifugal field of possibly several thousand times gravitational acceleration. Under the influence of this field the air, being much less dense than the water, flows rapidly to the inside diameter of the rotating liquid ring inside the gill ring. The continuous entrainment of the air effects a compression and the air in space 21 is therefore at a higher pressure than the air outside the gill ring in space 20. The compressed air leaves the compressor through discharge 22.

The compressor will, of course, operate with gases other than air or with light fluids and with working fluids other than water. It will also operate as a vacuum pump by connecting inlet 19 to the vacuum system. It can also be used to contact gases or vapors with liquids or liquids with liquids while simultaneously compressing or pumping as desired.

Figure 5:
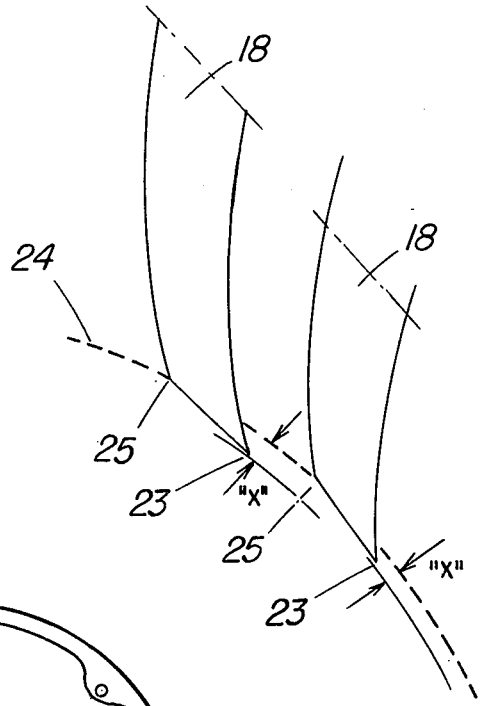
FIG. 5 is an enlarged fragmentary view of the inner end of the gill ring.

The water is retained within gill ring 17 by the effect of the gill ring vanes on its motion. The effect of centrifugal force on the liquid will be to tend to cause it to be flung outwards between the stationary vanes 18 of the gill ring. This can be prevented by using a configuration similar to that shown in FIG. 5 for the inside of the gill ring. The trailing edge 23 of each stationary vane 18 is stepped into the inner gill ring circle 24 further than the leading edge 25 by a distance "$x$" which is dependent upon design factors including the separation of the stationary vanes, the design speed and the intended working fluid. The distance "$x$" is selected such that it is at least as great as the distance by which the liquid will move radially outwards (under the influence of centrifugal force) in the time it takes to pass between the trailing edge of one vane to the leading edge of the next vane.

Figure 3:
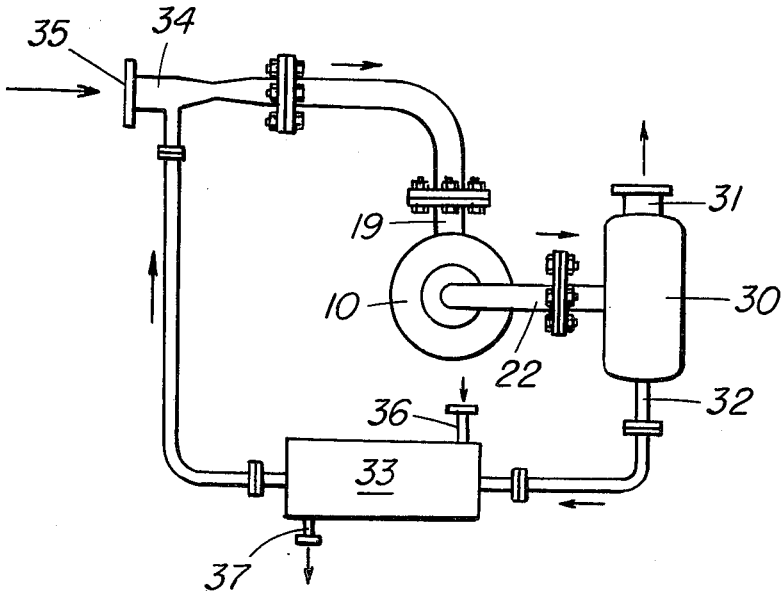
FIG. 3 is a schematic diagram of a typical installation using the compressor.

Since the compressor requires a working fluid such as water for its operations and since some of this fluid will inevitably be carried out with the gas, a separator is preferably provided, as shown in FIG. 3. The discharge outlet 22 is connected to a liquid/gas separator 30. In the separator the working fluid is separated and a clean gas stream is provided at gas outlet 31. The separated liquid is then returned in a closed cycle to the compressor by way of fluid outlet 32 and heat exchanger 33 and eductor 34 which returns the working fluid to the compressor. The gas inlet 35 to eductor 34 is connected to the vacuum system or the gas source, depending upon the system. Coolant for heat exchanger 33 is circulated through inlet 36 and outlet 37.

Figure 4A:
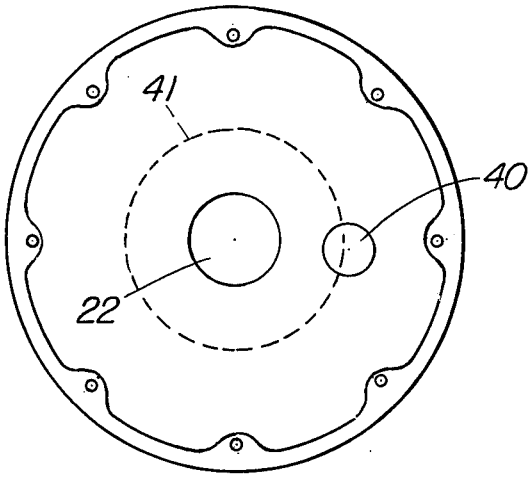
FIGS. 4A and 4B are views showing two different configurations for the compressor discharge outlets.
Figure 4B:
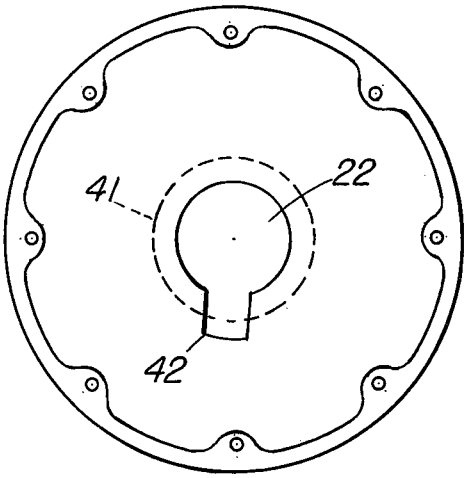

By recirculating the working fluid in this way, cooling can be provided for the compressor. Conversely, if a once-through system is desired, sufficient fluid can be injected into the inlet to provide the desired cooling without the need for recirculation. If desired, a separate outlet for the recirculating fluid may be provided, as shown in FIG. 4A. In this case, a small fluid outlet 40 is provided in the casing cover plate 11 for the working fluid in addition to gas discharge 22. Fluid outlet 40 is positioned so that in use it is partly within the annular region 41 occupied by the rotating liquid ring. Alternatively, as shown in FIG. 4B, a cut-out 42 can be provided in discharge outlet 22, this cut-out extending into the annular region 41 occupied by the liquid ring, so that liquid can be continuously removed through cut-out 42. Such configurations will minimize liquid entrainment by the discharged gas.

The clearance 26 between the vanes of the rotor and the inner edge of the gill ring is not highly critical because the rotor serves only to impart movement and energy to the rotating ring of working fluid.

The rotor 15 may have straight blades or vanes as shown in FIG. 2 or they may be curved either forwards or backwards to give different operating characteristics as desired.

The stationary vanes 18 may be attached to the casing by any suitable means e.g. by pins or they may be attached by keys which fit in corresponding keyways in the casing. FIG. 6A shows one possible configuration for the vanes. In this case, the vanes 18A are attached by keys 50 which fit in corresponding keyways in casing 10 and cover plate 11. The gas to be compressed then enters the gill ring at the outer edge of the stationary vanes, as indicated by the arrows.

Figure 6B:
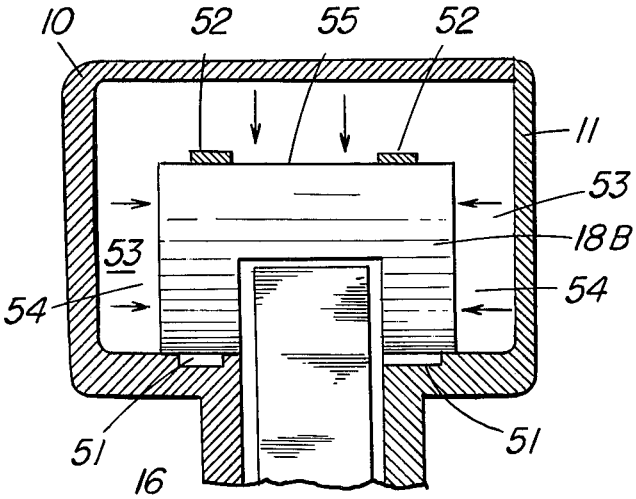
FIGS. 6A and 6B are enlarged fragmentary views of sections through two different types of gill ring.
Figure 6A:
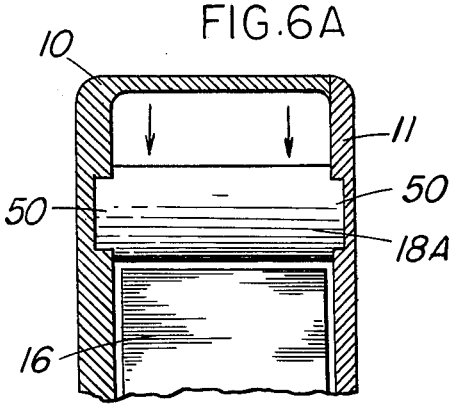

An alternative configuration is shown in FIG. 6B. The stationary vanes 18B are attached to casing 10 and cover plate 11 by keys 51 in corresponding keyways in the casing and cover plate and in addition retaining rings 52 pass around the outside of the gill ring. The casing 10 and cover plate 11 are enlarged in the region of the gill ring to provide gas flow passages 53 around the sides 54 of stationary vanes 18B as well as their edges 55 on the outside of the gill ring.

The vanes may be formed in other ways also. For example, if desired, and if practicable for a given configuration, the vanes could be cast or machined integrally with the casing 10 or the cover plate 11. They could also be assembled into a separate sub-unit which could then be inserted into the casing and secured by appropriate fixtures.

The compressor will be capable of achieving any suction pressure (vacuum) that can be produced by a single stage eductor. On the discharge side, the pressure can be quite high, depending on design factors which effect the entrainment, for example, gill ring configuration, rotor speed and mechanical strength.

High compression ratios are possible for each stage. Further, since the entrainment area is favorable as compared to that of an eductor (which itself is a high volume device) the possibilities for high flow rates are good.

The compressor may also operate as a gas/liquid centrifugal separator. In this case, the constructions shown in FIGS. 4A and 4B will be especially advantageous since they provide separate outlets for the two fluids.

I claim:

1. A compressor which comprises:

(i) a casing, (ii) a rotor journalled for rotation inside the casing, (iii) a gill ring comprising a plurality of closely spaced stationary vanes positioned around the periphery of the rotor for directing incoming fluid to be compressed into a rotating annulus of working fluid within the gill ring for entrainment in the ring of working fluid, (iv) a fluid inlet communicating with the space outside the gill ring, and (v) a fluid outlet communicating with the space inside the gill ring.

2. The compressor of claim 1 wherein the stationary vanes are of streamline section in the direction of fluid flow.

3. The compressor of claim 1 wherein each stationary vane has a leading edge and a trailing edge at its inner extremity, the trailing edge of each vane extending further inwards than the leading edge.

4. The compressor of claim 1 in which the fluid outlet is positioned on the axis of the rotor.

5. The compressor of claim 4 which further comprises an additional fluid outlet between the axis of the rotor and the gill ring.

6. The compressor of claim 1 which includes a working fluid.

7. The compressor of claim 6 in which the working fluid is water.

8. A compressor for gases which comprises:

(i) a casing, (ii) a rotor having radially-extending vanes for imparting rotational movement to a working fluid and journalled for rotation within the casing, (iii) a gill ring comprising a plurality of closely spaced stationary vanes positioned around the periphery of the rotor for directing incoming fluid to be compressed into a rotating annulus of working fluid within the gill ring for entrainment in the ring of working fluid;

(iv) a fluid flow passage surrounding the outer periphery of the gill ring, (v) a fluid flow inlet communicating with the fluid flow passage surrounding the outer periphery of the gill ring, (vi) a fluid discharge outlet for compressed gas communicating with the space inside the gill ring.

9. The compressor of claim 8 in which the fluid discharge outlet is disposed within the region exteriorly bounded by the inner periphery of the rotating annulus of working fluid.

10. The compressor of claim 9 in which the fluid discharge outlet is disposed on the axis of the rotor.

11. The compressor of claim 10 which includes a discharge outlet for the working fluid partly within the region bounded by the inner and outer peripheries of the rotating annulus of working fluid.

12. In a gas compressor system which comprises a compressor, means for admitting gas to be compressed into the compressor, means for admitting a working fluid to the compressor, a liquid/gas separator connected to the discharge outlet of the compressor for separating compressed gas from liquid entrained therein, the improvement comprising a compressor having:

(i) a casing, (ii) a rotor having radially-extending vanes for imparting rotational movement to a working fluid and journalled for rotation with the casing, (iii) a gill ring comprising a plurality of closely spaced stationary vanes positioned around the periphery of the rotor for directing incoming fluid to be compressed into a rotating annulus of working fluid within the gill ring for entrainment in the ring of working fluid, (iv) a fluid flow passage surrounding the outer periphery of the gill ring, (v) a fluid flow inlet communicating with the fluid flow passage surrounding the outer periphery of the gill ring, (vi) a fluid discharge outlet for compressed gas communicating with the space inside the gill ring.

13. The system of claim 12 which includes means for recirculating working fluid from the liquid/gas separator to the compressor.

14. The system of claim 13 which includes means for cooling the recirculated working fluid.

15. A method of compressing a gas, which comprises the steps of:

(i) passing a gas to be compressed through a gill ring comprising a plurality of closely spaced stationary vanes positioned around the periphery of a rotor, (ii) flowing a rotating annulus of working liquid past the inner periphery of the gill ring thereby to entrain the gas into the rotating annulus of liquid, (iii) separating the gas entrained in the liquid from the rotating annulus of the liquid, (iv) removing the separated, compressed gas from the side of the rotating annulus remote from the gill ring.

16. A method according to claim 15 in which the gas is separated from the liquid by means of a centrifugal field.

* * * * *